US005472570A

United States Patent [19]

Echt

[11] Patent Number: 5,472,570

[45] Date of Patent: Dec. 5, 1995

[54] PHENOLIC COMPOUND/POLYETHYLENE OXIDE RETENTION SYSTEM

[75] Inventor: Elliott Echt, Wilmington, Del.

[73] Assignee: Hercules Incorporated, Wilmington, Del.

[21] Appl. No.: 217,591

[22] Filed: Mar. 24, 1994

Related U.S. Application Data

[63] Continuation-in-part of Ser. No. 36,745, Mar. 25, 1993, abandoned.

[51] Int. Cl.[6] ..... D21H 21/10

[52] U.S. Cl. ..... 162/164.1; 162/164.3; 162/168.1; 162/183

[58] Field of Search ..... 162/164.1, 164.3, 162/168.1, 183

[56] References Cited

U.S. PATENT DOCUMENTS

| | | | |
|---|---|---|---|
| 3,141,815 | 7/1964 | Manley | 162/164 |
| 4,070,236 | 1/1978 | Carrard et al. | 162/164 |
| 4,313,790 | 2/1982 | Pelton et al. | 162/163 |
| 5,173,208 | 12/1992 | Chung et al. | 162/168.1 |

OTHER PUBLICATIONS

Polysciences, Inc., Data Sheet, Poly(P–Vinyl Phenol).

K. R. Stack, et al., "Study of the Interaction between Poly(Ethylene Oxide) and Phenol–Formaldehyde Resin", *Colloids and Surfaces,* V61, pp. 205–218, 1991.

T. Lindstrom et al, "Network Flocculation and Fractionation . . . Resin Complex" *Journal of Colloid and Interface Science,* V97, No. 1, pp. 62–67, Jan. 1984.

*Primary Examiner*—Chin: Peter

*Attorney, Agent, or Firm*—Ivan G. Szanto; Roy V. Jackson

[57] ABSTRACT

A paper-making furnish, comprising poly(paravinyl phenol), also known as poly(hydroxy styrene), in admixture with polyethylene oxide, and a process for retaining fine particles in paper-making comprising adding poly(paravinyl phenol) and polyethylene oxide to a paper-making furnish, are disclosed.

45 Claims, No Drawings

PHENOLIC COMPOUND/POLYETHYLENE OXIDE RETENTION SYSTEM

This application is a continuation-in-part of application Ser. No. 8/036,745 filed Mar. 25, 1993, now abandoned.

This invention relates to fine-particle retention aids for paper-making processes, comprising phenolic compounds.

BACKGROUND OF THE INVENTION

Phenolic resins with sulfur or formaldehyde are described in U.S. Pat. No. 4,070,236 as being useful as additives for improving fine particle retention in paper manufacturing when used in conjunction with a poly(alkylene oxide) having a molecular weight of 4 to 7 million, specifically the preferred poly(ethylene oxide) (PEO) or co-condensed polyethylene/polypropylene oxide; poly(propylene oxide) is mentioned (but there would appear to be a problem of solubility with polyalkylene oxides other than poly(ethylene oxide)).

K. R. Stack, L. A. Dunn, and N. K. Roberts, show in "Study of the Interaction Between Poly(ethylene oxide) and Phenol-Formaldehyde Resin", *Colloids and Surfaces* (61), 1991, pp 205–218, how varying the environment and certain properties of the phenol-formaldehyde resin can affect the performance of the phenol-formaldehyde resin/PEO system. T. Lindstrom and G. Glad-Nordmark in "Network Flocculation and Fractionation of Latex Particles by Means of a Polyethyleneoxide-Phenolformaldehyde Resin Complex", *J. Colloid and Interface. Science*, Vol. 97, No. 1, January 1984, pp 62–67 propose a mechanism they refer to as "... transient network ..." of hydrogen bonded poly(ethylene oxide) and phenol-formaldehyde resin which swept the fine particles from the system.

The references indicate that the effectiveness of poly(ethylene oxide) for improving fine particle retention increases with its molecular weight; the effectiveness below a MW of 2 million being poor and a MW of 4 to 7 million being desirable.

However, the combination of phenol-formaldehyde resin and poly(ethylene oxide) functions less effectively as the pH is reduced below 5. The resin component also introduces formaldehyde or naphthol into the paper-making system.

There is therefore a need for a new retention aid that avoids the introduction of hazardous substances such as formaldehyde, and that can function at a lower pH, such as under 5, as well as at higher pH levels conventionally used in paper-making.

SUMMARY OF THE INVENTION

According to the invention, a paper-making furnish containing a 15 phenolic compound in admixture with a soluble polyalkylene oxide having a molecular weight over one million as a retention aid for retaining fine particles, characterized in that the phenolic compound is poly(paravinyl phenol), also known as poly(parahydroxy styrene), and preferably is poly(ethylene oxide).

Also according to the invention, a process for retaining fine particles in paper-making comprising adding to a paper pulp slurry a phenolic compound in admixture with a soluble polyalkylene oxide preferably poly(ethylene oxide) having a molecular weight over one million and a poly(paravinyl phenol).

It is preferred to add alum and/or a cationic polymeric coagulant, such as a polyamine, to the composition according to the invention, to improve retention by coagulating fine particles to a larger size that is better retained by this invention.

The amount of the retention aid used is preferably such that the poly(ethylene oxide) added to the pulp is in the range of about 0.01% to about 0. 1% by weight of the paper furnish, more preferably from 0.01% to about 0.05%, and the poly(paravinyl phenol) is preferably in the ratio of 0.5 to 10 times the weight of the poly(ethylene oxide).

The poly(paravinyl phenol) functions at pH levels under 5, as well as at higher pH levels, and avoids the introduction of formaldehyde or other hazardous substances into the paper-making system.

The molecular weight of the poly(ethylene oxide) should be as high as possible, preferably between 4 and 7 million and most preferably at least 5 million.

DETAILED DESCRIPTION OF THE INVENTION

The paper can be made with bleached or unbleached chemical pulps, mechanical pulps, chemi-mechanical pulps, or recycled pulps. It can include conventional additives such as sizing agents, fillers such as titanium dioxide, calcium carbonate, kaolin clay, or talc, and polymeric additives such as wet strength resins, polyamines or polyamide-amines, or polyacrylamide polymers or copolymers of acrylamide.

The retention system functions well at a wide range of ratios of the poly(ethylene oxide) to the poly(paravinyl phenol). Conventional tests, such as those described below in the Examples, can be done on a particular paper stock sample to determine the optimum ratio for a given application of the composition and process according to the invention.

Within the preferred ratio of 0.5 to 10 times the weight of the poly(ethylene oxide), a more preferred ratio of poly(paravinyl phenol) to poly(ethylene oxide)is 6:1 to 1:1.25 (0.8 to 6 times). The most preferred embodiment of the invention uses a ratio of poly(paravinyl phenol) to poly(ethylene oxide) of about 2:1 to about 3:1, with cost considerations favoring the lowest effective ratio in a particular paper-making system.

A phenolic resin currently in use as an additive in conjunction with polyethylene oxide, Reichhold resin BB-139 from Reichhold Chemicals, was compared to poly(paravinyl phenol) as a retention aid in paper furnishes collected from commercial mills, and these control results are compared with those obtained by using the composition and process according to the invention:

EXAMPLES AND CONTROL EXPERIMENTS

Procedure:

The retentions and drainage were measured in a drainage jar referred to as the Portable Dynamic Drainage Tester, similar to drainage jars used in the industry with the exception that additives are added to an aliquot that is agitated before it is added to the drainage jar. Since the Portable Dynamic Drainage Tester has an open outlet, drainage starts immediately upon addition of the sample to the tester.

The procedure for the Portable Dynamic Drainage Tester (PDDT) is to measure about 200 ml of a stock sample at headbox consistency into a 1000 ml plastic graduated cylinder. This sample is inverted six times, then any additive is added to the cylinder, and an additional six inversions of the cylinder are made before pouring the sample into the top of the PDDT. If more than one additive is used, the sample is inverted six times between additives, with an additional six inversions between the last additive and pouring the sample into the PDDT. For these experiments the PEO, phenolic resin, and poly(paravinyl phenol) were diluted to 0. 1% for additions. The poly(paravinyl phenol) was dissolved in distilled water by adding dilute sodium hydroxide dropwise until the poly(paravinyl phenol) dissolved.

Chemical additive addition is noted below in pounds per ton, where pounds are the pounds of chemical and tons are the tons of paper furnish in the 200 ml. sample. For example, I ml. of 0.1% PEO in 200 gms. of 0.5% wood pulp is equivalent to 0.1% or two pounds of PEO per ton of furnish. In these examples, the phenol-formaldehyde resin or poly-(paravinyl phenol) was always added before the PEO.

The PDDT agitator is operating at 750 rpm with the bottom valve open at the time of sample addition. The time is noted for 50, 75, and 100 ml of liquid to drain from the sample during the test. When 100 ml. of "white water" is collected the bottom valve is closed and the solids in the white water is determined. This white water solids value is compared to total solids for first pass retention and to fines content for fine particle retention. Fine particle retention is a more sensitive test.

The fines content is defined as the dry weight of material per 100 ml of white water that passes through the screen of the PDDT when the stirrer at 750 rpm is held against the screen during an experimental run with no polymers added.

In Tables 1 and 2, the comparative tests and Examples used poly(paravinyl phenpoll) with a MW ranging from 1,500 to 7,000 from Polysciences Inc., Warrington, Pa. Catalogue No. 6257, CAS NO. 24979-70-2. The phenolic resin was BB-139 from Reichhold Chemicals. The poly(ethylene oxide) was from Polysciences, Inc., Warrington, Pa. In Table 3, the PEO was either Polyox 301, MW 4,000,000 or Polyox 303, MW 7,000,000, both from Union Carbide Corporation and the furnish was otherwise the same as that in Table 2.

TABLE 1

A furnish consisting of 85% chemi-thermomechanical pulp and 15% kraft pulp with 20 pounds of alum per ton from a newsprint mill was tested in a PDDT at 0.48% consistency with the following results:

| pH | Pounds per ton: poly(paravinyl phenol) | Pounds per ton: Phenolic Resin | Pounds per ton: PEO | Fines Retention | Drainage Time Secs. to 100 ml. |
|---|---|---|---|---|---|
| 4 | 0 | 0.8 | 0.2 | 2.54% | 17 |
| 4 | 0 | 0.8 | 0.4 | 12.87 | 17 |
| 4 | 0 | 0.8 | 0.8 | 26.06 | 19 |
| 4 | 0 | 0.8 | 1.0 | 19.03 | 18 |
| 4 | 0.8 | 0 | 0.2 | 7.5 | 19 |
| 4 | 0.8 | 0 | 0.4 | 16.60 | 19 |
| 4 | 0.8 | 0 | 0.8 | 24.75 | 18 |
| 4 | 0.8 | 0 | 1.0 | 32.09 | 16 |
| 4 | 0 | 1.2 | 0.2 | 7.34 | 17 |
| 4 | 0 | 1.2 | 0.4 | 17.34 | 16 |
| 4 | 0 | 1.2 | 0.8 | 17.25 | 15 |
| 4 | 0 | 1.2 | 1.0 | 24.70 | 16 |
| 4 | 1.2 | 0 | 0.2 | 5.36 | 17 |
| 4 | 1.2 | 0 | 0.4 | 13.76 | 17 |
| 4 | 1.2 | 0 | 0.8 | 29.10 | 17 |
| 4 | 1.2 | 0 | 1.0 | 35.06 | 15 |
| 5 | 0 | 0.8 | 0.2 | 8.05 | 20 |
| 5 | 0 | 0.8 | 0.4 | 18.70 | 20 |
| 5 | 0 | 0.8 | 0.8 | 41.09 | 17 |
| 5 | 0 | 0.8 | 1.0 | 49.10 | 16 |
| 5 | 0.8 | 0 | 0.2 | 18.06 | 20 |
| 5 | 0.8 | 0 | 0.4 | 35.54 | 18 |
| 5 | 0.8 | 0 | 0.8 | 57.29 | 14 |
| 5 | 0.8 | 0 | 1.0 | 58.29 | 12 |
| 5 | 0 | 1.2 | 0.2 | 5.36 | 19 |
| 5 | 0 | 1.2 | 0.4 | 23.70 | 18 |
| 5 | 0 | 1.2 | 0.8 | 40.45 | 16 |
| 5 | 0 | 1.2 | 1.0 | 49.73 | 15 |
| 5 | 1.2 | 0 | 0.2 | 17.45 | 21 |
| 5 | 1.2 | 0 | 0.4 | 30.85 | 18 |
| 5 | 1.2 | 0 | 0.8 | 61.41 | 14 |
| 5 | 1.2 | 0 | 1.0 | 64.85 | 13 |

TABLE 2

A furnish of 72% Thermomechanical pulp and 28% kraft pulp was obtained from a paper mill and tested in the PDDT with the following results:

| pH | Pounds per ton: poly(paravinyl phenol) | Pounds per ton: Phenolic Resin | Pounds per ton: PEO | Fines Retention | Drainage Time Secs. to 100 ml. |
|---|---|---|---|---|---|
| 4 | 0 | 0.8 | 0.2 | −1.29% | 18 |
| 4 | 0 | 0.8 | 0.4 | −2.47 | 17 |
| 4 | 0 | 0.8 | 0.8 | −2.33 | 17 |
| 4 | 0 | 0.8 | 1.0 | 1.06 | 18 |
| 4 | 0.8 | 0 | 0.2 | 4.14 | 17 |
| 4 | 0.8 | 0 | 0.4 | 10.12 | 16 |
| 4 | 0.8 | 0 | 0.8 | 22.34 | 16 |
| 4 | 0.8 | 0 | 1.0 | 32.76 | 15 |
| 4 | 0 | 1.2 | 0.2 | −2.92 | 18 |
| 4 | 0 | 1.2 | 0.4 | 1.31 | 19 |
| 4 | 0 | 1.2 | 0.8 | 4.84 | 19 |
| 4 | 0 | 1.2 | 1.0 | 7.88 | 19 |
| 4 | 1.2 | 0 | 0.2 | 4.78 | 17 |
| 4 | 1.2 | 0 | 0.4 | 12.67 | 16 |
| 4 | 1.2 | 0 | 0.8 | 26.40 | 16 |
| 4 | 1.2 | 0 | 1.0 | 27.54 | 15 |
| 5 | 0 | 0.8 | 0.2 | −0.51 | 19 |
| 5 | 0 | 0.8 | 0.4 | 38.94 | 16 |
| 5 | 0 | 0.8 | 0.8 | 45.90 | 16 |
| 5 | 0 | 0.8 | 1.0 | 62.03 | 14 |
| 5 | 0.8 | 0 | 0.2 | 11.11 | 19 |
| 5 | 0.8 | 0 | 0.4 | 21.87 | 19 |
| 5 | 0.8 | 0 | 0.8 | 46.54 | 15 |
| 5 | 0.8 | 0 | 1.0 | 59.04 | 13 |
| 5 | 0 | 1.2 | 0.2 | 7.86 | 18 |
| 5 | 0 | 1.2 | 0.4 | 28.00 | 19 |
| 5 | 0 | 1.2 | 0.8 | 62.54 | 13 |
| 5 | 0 | 1.2 | 1.0 | 62.70 | 12 |
| 5 | 1.2 | 0 | 0.2 | 9.42 | 20 |
| 5 | 1.2 | 0 | 0.4 | 18.52 | 20 |
| 5 | 1.2 | 0 | 0.8 | 49.47 | 16 |
| 5 | 1.2 | 0 | 1.0 | 53.89 | 14 |

TABLE 3

A furnish of 72% Thermomechanical pulp and 28% kraft pulp was obtained from a paper mill and tested in the PDDT with the following results:

| pH | Pounds per ton: poly(paravinyl phenol) | Pounds per ton: Phenolic Resin | Pounds per ton: PEO | Fines Retention | Drainage Time Secs. to 100 ml. |
|---|---|---|---|---|---|
| 5.1 | 0 | 0.26 | *0.51 | 16.92 | 54 |
| 5.1 | 0 | 0.51 | *0.51 | 47.40 | 34 |
| 5.1 | 0 | 1.04 | *0.52 | 63.19 | 18 |
| 5.1 | 0 | 1.54 | *0.51 | 65.85 | 17 |
| 5.1 | 0 | 1.98 | *0.49 | 51.02 | 26 |
| 5.1 | 0.27 | 0 | *0.53 | 10.30 | 58 |
| 5.1 | 0.51 | 0 | *0.51 | 25.23 | 48 |
| 5.1 | 1.03 | 0 | *0.52 | 68.34 | 9 |
| 5.1 | 1.54 | 0 | *0.51 | 63.62 | 14 |
| 5.1 | 2.04 | 0 | *0.51 | 56.35 | 14 |
| 5.1 | 0.52 | 0 | **0.52 | 28.41 | 46 |
| 5.1 | 1 | 0 | **0.5 | 80.33 | 9 |
| 5.1 | 1.49 | 0 | **0.5 | 60.41 | 22 |
| 5.1 | 1.98 | 0 | **0.49 | 48.34 | 16 |
| 5.1 | 0 | 0.5 | **0.5 | 33.80 | 44 |
| 5.1 | 0 | 1 | **0.5 | 52.56 | 26 |
| 5.1 | 0 | 1.54 | **0.51 | 58.00 | 19 |
| 5.1 | 0 | 1.97 | **0.49 | 56.70 | 23 |

*Polyox 303 from Union Carbide Corp.
**Polyox 301 from Union Carbide Corp.

Two additional samples of poly(paravinylphenol) were used in the process according to the invention as follows: (1) Poly(paravinylphenol) from Maruzen Petrochemical Co., LTD., "Maruka Lyncur M", Grade S-2, CAS NO. 24979-70-2, Weight Avg. Molecular weight (manufacturer's data): 5,200; and (2) Poly(paravinylphenol) from Maruzen Petrochemical Co., LTD., "Maruka Lyncur M", Grade H-2, CAS NO. 24979-70-2, Weight Avg. Molecular weight (manufacturer's data): 23,000.

The resins were tested for performance together with Union Carbide Polyox 301 polyethyleneoxide for retention of fine particles in a newsprint pulp sample of 85% CTMP pulp and 15% kraft pulp. The comparison was done with 0.045 to 0.05% polyethylene oxide by weight of the pulp furnish. The Reichold BB-139 phenol formaldehyde resin is included for comparison.

TABLE 4

COMPARISON OF HIGH AND LOW MOLECULAR WEIGHT POLYPARAVINYL PHENOL PER CENT FINES RETENTION

| Maruzen Grade S-2 Ratio of phenolic/ PEO | Maruzen Grade S-2 % Fines retention | Maruzen Grade H-2 Ratio of phenolic/ PEO | Maruzen Grade H-2 % Fines retention | Reichold BB-139 Ratio of phenolic/ PEO | Reichold BB-139 % Fines Retention |
|---|---|---|---|---|---|
| 0.51 | 58.56 | 0.51 | 60.58 | 0.5 | 30.87 |
| 1.0 | 75.73 | 1.0 | 77.71 | 1.0 | 50.65 |
| 1.5 | 74.70 | 1.51 | 77.41 | 1.49 | 54.42 |
| 2.0 | 75.25 | 2.0 | 73.76 | — | — |
| 3.01 | 60.33 | 3.01 | 56.97 | — | — |
| 3.98 | 43.06 | 3.98 | 52.17 | — | — |

The data shows that at low ratios of poly(paravinylphenol) to PEO, there is an advantage for the higher molecular weight material for fines retention.

TABLE 5

COMPARISON OF HIGH AND LOW MOLECULAR WEIGHT POLYPARAVINYL PHENOL DRAINAGE TIME TO 100 ML.

| Maruzen Grade S-2 Ratio of phenolic/ PEO | Maruzen Grade S-2 Drainage, Seconds to 100 ml. | Maruzen Grade H-2 Ratio of phenolic/ PEO | Maruzen Grade H-2 Drainage, Seconds to 100 ml. | Reichold BB-139 Ratio of phenolic/ PEO | Reichold BB-139 Drainage, Seconds to 100 ml. |
|---|---|---|---|---|---|
| 0.51 | 16 | 0.51 | 12 | 0.5 | 11 |
| 1.0 | 13 | 1.0 | 9 | 1.0 | 11 |
| 1.5 | 14 | 1.51 | 9 | 1.49 | 12 |
| 2.0 | 13 | 2.0 | 15 | — | — |
| 3.01 | 13 | 3.01 | 16 | — | — |
| 3.98 | 14 | 3.98 | 15 | — | — |

There is an advantage for the higher molecular weight material for more rapid drainage.

Thus it has been shown that poly(paravinyl phenol) is an effective substitute for phenol-formaldehyde resin and that under some circumstances performs more effectively on a pound for pound basis: as the pH is lowered from 5 to 4 the poly(paravinyl phenol)is consistently more effective than the phenolformaldehyde resin. The additional advantage of the poly(paravinyl phenol) is that it contains no formaldehyde.

I claim:

1. A paper-making furnish comprising, as retention agents for retaining fine particles, poly(paravinyl phenol) having a molecular weight of over 1500 in admixture with a soluble poly(alkylene oxide) having a molecular weight of over one million, wherein the weight ratio of poly(paravinyl phenol) to poly(alkylene oxide) is from about 0.5:1 to about 10:1.

2. A paper-making furnish as claimed in claim 1 in which the poly(alkylene oxide) is poly(ethylene oxide).

3. A paper-making furnish as claimed in claim 2 in which the poly(ethylene oxide) has a molecular weight of from about 1 million to 7 million.

4. A paper-making furnish as claimed in claim 3 in which the poly(ethylene oxide) has a molecular weight of at least 4 million.

5. A paper-making furnish as claimed in claim 1 in which the weight of poly(paravinyl phenol) is in the range of from about 0.8 to about 6 times the weight of the poly(ethylene oxide).

6. A paper-making furnish as claimed in claim 2 in which the weight of poly(paravinyl phenol) is in the range of from about 0.8 to about 6 times the weight of the poly(ethylene oxide).

7. A paper-making furnish as claimed in claim 3 in which the ratio of poly(paravinyl phenol) to poly(ethylene oxide) is in the range of 1:1.25 to 6:1.

8. A paper-making furnish as claimed in claim 4 in which the ratio of poly(paravinyl phenol) to poly(ethylene oxide) is in the range of 1:1.25 to 6:1.

9. A paper-making furnish as claimed in claim 7 in which the ratio of poly(paravinyl phenol) to poly(ethylene oxide) is in the range of 2:1 to 3:1.

10. A paper-making furnish as claimed in claim 8 in which the ratio of poly(paravinyl phenol) to poly(ethylene oxide) is in the range of 2:1 to 3:1.

11. A paper-making furnish as claimed in claim 1 that includes a coagulant.

12. A paper-making furnish as claimed in claim 2 that includes a coagulant.

13. A paper-making furnish as claimed in claim 3 that includes a coagulant.

14. A paper-making furnish as claimed in claim 4 that includes a coagulant.

15. A paper-making furnish as claimed in claim 1, in which the amount of poly(paravinyl phenol) in admixture with the poly(alkylene oxide) is such that the poly(alkylene oxide) added to the pulp is in the range of 0.01% to 0.1% by weight of the paper furnish.

16. A paper-making furnish as claimed in claim 2, in which the amount of poly(paravinyl phenol) in admixture with the polyalkylene oxide is such that the poly(ethylene oxide) added to the pulp is in the range of 0.01% to 0.1% by weight of the paper furnish.

17. A paper-making furnish as claimed in claim 3, in which the amount of poly(paravinyl phenol) in admixture with the polyalkylene oxide is such that the poly(ethylene oxide) added to the pulp is in the range of 0.01% to 0.1% by weight of the paper furnish.

18. A paper-making furnish as claimed in claim 4, in which the amount of poly(paravinyl phenol) in admixture with the polyalkylene oxide is such that the poly(ethylene oxide) added to the pulp is in the range of 0.01% to 0.1% by weight of the paper furnish.

19. A paper-making furnish as claimed in claim 15 in which the amount of the poly(ethylene oxide) is in the range of about 0.01% to about 0.05% by weight of the paper-making furnish.

20. A paper-making furnish as claimed in claim 7, in which the amount of the poly(ethylene oxide) in admixture with the poly(paravinyl phenol) is such that the poly(ethylene oxide) added to the pulp is in the range of about 0.01% to about 0.1% by weight of paper-making furnish.

21. A paper-making furnish as claimed in claim 17, in which the amount of the poly(ethylene oxide) is in the range of about 0.01% to about 0.05% by weight of the paper-making furnish.

22. A paper-making furnish as claimed in claim 18, in which the amount of the poly(ethylene oxide) is in the range of about 0.01% to about 0.05% by weight of the paper-making furnish.

23. A process for retaining fine particles in paper-making comprising adding poly(paravinyl phenol having a molecular weight of over 1500 and a poly(alkylene oxide) having a molecular weight of over one million to a paper-making furnish, wherein the weight ratio of poly(paravinyl phenol) to poly(alkylene oxide) is from about 0.5:1 to about 10:1.

24. A process for retaining fine particles in paper-making as claimed in claim 23 in which the poly(alkylene oxide) is poly(ethylene oxide).

25. A process for retaining fine particles in paper-making as claimed in claim 24 in which the poly(ethylene oxide) has a molecular weight of 4 to 7 million.

26. A process for retaining fine particles in paper-making as claimed in claim 25 in which the poly(ethylene oxide) has a molecular weight of at least 5 million.

27. A process for retaining fine particles in paper-making as claimed in claim 23, in which the weight of poly(paravinyl phenol) is in the range of from about 0.8 to about 6 times the weight of the poly(alkylene oxide).

28. A process for retaining fine particles in paper-making as claimed in claim 24, in which the weight of poly(paravinyl phenol) is in the range of from about 0.8 to about 6 times the weight of the poly(ethylene oxide).

29. A process for retaining fine particles as claimed in claim 25 in which the amount of the poly(alkylene oxide) is in the range of about 0.01% to about 0.1% by weight of the paper-making furnish.

30. A process for retaining fine particles as claimed in claim 26 in which the amount of the poly(alkylene oxide) is in the range of about 0.01% to about 0.1% by weight of the paper-making furnish.

31. A process for retaining fine particles as claimed in claim 23 in which the amount of the poly(ethylene oxide) is in the range of about 0.01% to about 0.1% by weight of the paper-making furnish.

32. A process for retaining fine particles as claimed in claim 23 in which the ratio of poly(paravinyl phenol) to poly(ethylene oxide) is in the range of 2:1 to 3:1.

33. A process for retaining fine particles as claimed in claim 24 in which the ratio of poly(paravinyl phenol) to poly(ethylene oxide) is in the range of 2:1 to 3:1.

34. A process for retaining fine particles as claimed in claim 24 in which the amount of the poly(ehtylene oxide) is in the range of about 0.01% to about 0.1% by weight of paper-making furnish.

35. A process for retaining fine particles as claimed in claim 29 in which the amount of the poly(ethylene oxide) is in the range of about 0.01% to about 0.05% by weight of paper-making furnish.

36. A process for retaining fine particles as claimed in claim 34 in which the amount of the poly(ethylene oxide) is in the range of about 0.01% to about 0.05% by weight of the paper-making furnish.

37. A process for retaining fine particles as claimed in claim 30 in which the amount of the poly(ethylene oxide) is in the range of about 0.01% to about 0.05% by weight of the paper-making furnish.

38. A process for retaining fine particles as claimed in claim 35 in which a coagulant is added to the furnish.

39. A process for retaining fine particles as claimed in claim 36 in which a coagulant is added to the furnish.

40. A process for retaining fine particles in paper-making as claimed in claim 23 in which the pH of the paper-making furnish is below 5.

41. A process for retaining fine particles in paper-making as claimed in claim 24 in which the pH of the paper-making furnish is below 5.

42. A process for retaining fine particles in paper-making as claimed in claim 25 in which the pH of the paper-making furnish is below 5.

43. A process for retaining fine particles in paper-making as claimed in claim 26 in which the pH of the paper-making furnish is below 5.

44. Paper made by a process that includes the step of adding poly(paravinyl phenol) having a molecular weight of over 1500 and soluble poly(alkylene oxide) having a molecular weight of over one million to the paper-making furnish, wherein the weight ratio of poly(paravinyl phenol) to poly(alkylene oxide) is from about 0.5:1 to about 10:1.

45. Paper made by a process as claimed in claim 44 in which the poly(ethylene oxide) has a molecular weight of 4 to 7 million.

* * * * *